US008172623B1

(12) United States Patent
Zhu

(10) Patent No.: US 8,172,623 B1
(45) Date of Patent: May 8, 2012

(54) COMPRESSION CONNECTOR HAVING CONTACTING ENDS WITH CO-USED DEFORMING SECTION

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/103,937

(22) Filed: May 9, 2011

(30) Foreign Application Priority Data

Dec. 7, 2010 (CN) ..... 2010 2 0643907

(51) Int. Cl.
*H01R 9/22* (2006.01)

(52) U.S. Cl. ..... 439/709

(58) Field of Classification Search ..... 439/709, 439/66, 591, 862, 331, 884, 71
See application file for complete search history.

(56) References Cited

U.S. PATENT DOCUMENTS

| | | | | |
|---|---|---|---|---|
| 7,074,048 | B2 * | 7/2006 | Liao et al. | 439/66 |
| 7,775,805 | B2 * | 8/2010 | Liao et al. | 439/66 |
| 7,878,818 | B2 | 2/2011 | Cheng et al. | |
| 2009/0280689 | A1 * | 11/2009 | Lin et al. | 439/625 |
| 2009/0311900 | A1 * | 12/2009 | Liao | 439/331 |

* cited by examiner

*Primary Examiner* — Jean F Duverne
(74) *Attorney, Agent, or Firm* — Wei Te Chung; Andrew C. Cheng; Ming Chieh Chang

(57) ABSTRACT

A compression connector includes a housing and a plurality of terminals assembled to the housing. The insulative housing having a first mating surface and a second mating surface opposite to the first mating surface. Each terminal cavity disposed between and running through the first and second mating faces. Each terminal has a deforming portion received in the cavity, an upper contact and a lower contact extending from opposite ends of the deforming portion. The upper contact extending beyond the first mating surface and the lower contact extending beyond the second mating surface. The deforming portions are movably limited in the terminal cavities and will cause compressive deformation when either the upper contact or the lower contact is bearing an external pressure.

7 Claims, 5 Drawing Sheets

COMPRESSION CONNECTOR HAVING CONTACTING ENDS WITH CO-USED DEFORMING SECTION

BACKGROUND OF THE INVENTION

1. Field of the Invention

The present invention relates generally to a compression connector, and more particularly to a compression connector having contacting ends with co-used deforming section.

2. Description of Related Arts

An electrical connector is disclosed in U.S. Pat. No. 7,878,818 issued to Cheng et al. on Feb. 1, 2011. Said connector includes an insulative housing and a number of terminals received in the housing. The housing has a top surface and a bottom surface opposite to each other. Each of the terminals includes an engaging portion for securing the terminals in the housing, an upper arm and a lower arm extending from opposite ends of the base portion. The upper arm is elastically extending beyond the top surface of the housing and the lower arm is elastically extending beyond the bottom surface of the housing. However, each of the upper arm and the lower arm has independent and short elastic portion, which has low flexibility and will easily cause the arm crash.

Hence, a compression connector having contacting ends with co-used deforming section is desired.

SUMMARY OF THE INVENTION

Accordingly, an object of the present invention is to provide an electrical connector having contacting ends with co-used deforming section.

To achieve the above object, a compression connector includes a housing and a plurality of terminals assembled to the housing. The insulative housing having a first mating surface and a second mating surface opposite to the first mating surface. Each terminal cavity disposed between and running through the first and second mating faces. Each terminal has a deforming portion received in the cavity, an upper contact and a lower contact extending from opposite ends of the deforming portion. The upper contact extending beyond the first mating surface and the lower contact extending beyond the second mating surface. The deforming portions are movably limited in the terminal cavities and will cause compressive deformation when either the upper contact or the lower contact is bearing an external pressure.

Other objects, advantages and novel features of the invention will become more apparent from the following detailed description when taken in conjunction with the accompanying drawings.

DETAILED DESCRIPTION OF THE PREFERRED EMBODIMENT

Figure 1:
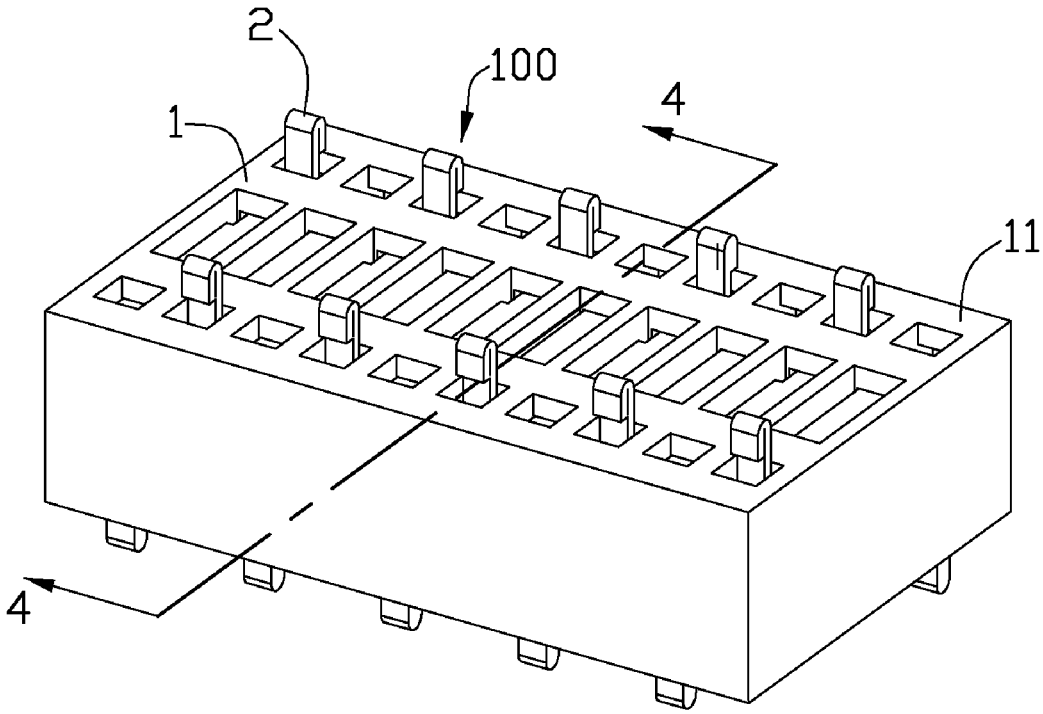
FIG. 1 is a perspective view of a compression connector in accordance with the present invention.
Figure 2:
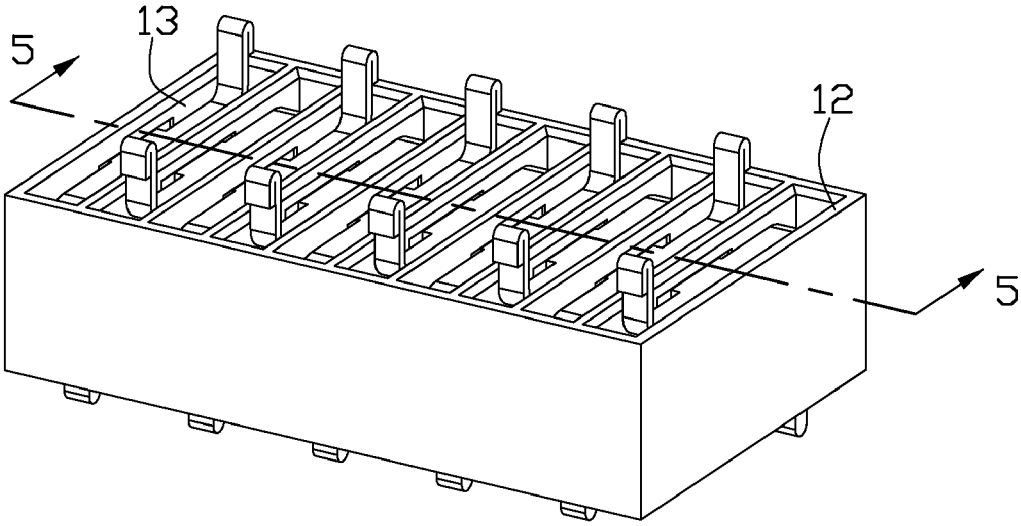
FIG. 2 is another perspective view of the compression connector of FIG. 1.

Referring to FIGS. 1-5, a compression connector 100 of the present invention, used for connecting with two circuit boards (not shown), includes an insulative housing 1 and a plurality of terminals 2 received in the housing 1. The insulative housing 1 includes a first mating face 11, a second mating face 12 opposite to the mating face 11 and a number of terminal cavities 13 disposed between the first and second mating faces 11, 12 of the housing and arranged along a longitudinal direction.

Figure 3:
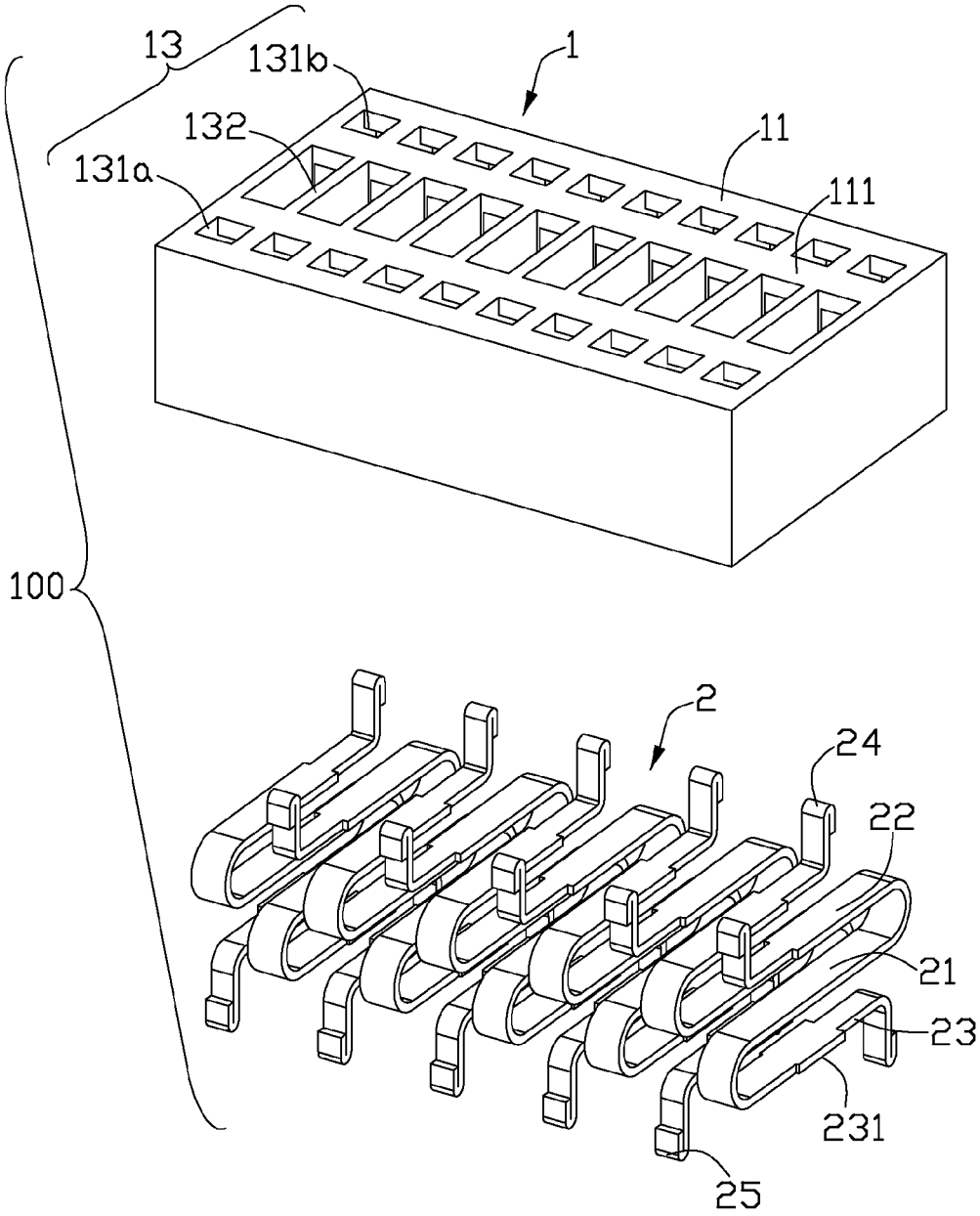
FIG. 3 is a perspective, exploded view of the compression connector.
Figure 4:
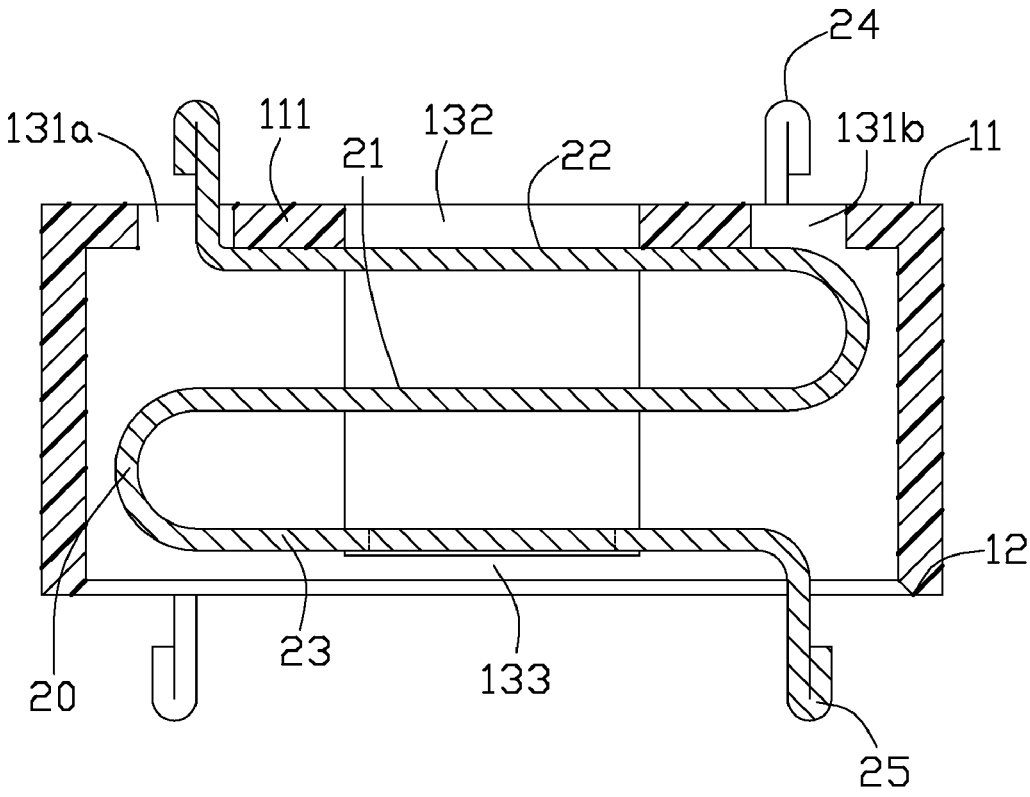
FIG. 4 is a cross section view of the compression connector taken along a broken line 4-4 in FIG. 1.

Referring to FIGS. 3&4, each terminal cavity 13 is depressed from the second mating face 12 to the first mating face 11 and forms two openings 131*a*/131*b* along the first mating face 11 and a stop wall 111 between the two openings. The number of cavities 13 forms two parallel rows of openings. A latching groove 132 with larger width than the terminal cavity 13 is depressed from the stop wall 111 of the first mating face 11 to form a latching section 133 nearing to but not running through the second mating face 12. The stop wall 111 and the latching section 133 of the terminal cavity 13 co-limit the terminal 2 in an upper and lower direction, which will be described in detail later.

Referring to FIG. 3, each terminal 2 bends from an elongate metal sheet along its longitudinal direction, comprising a deforming portion received in the cavity 13, an upper contact 24 and a lower contact 25 extending from opposite ends of the deforming portion 20. The deforming portion 20 is in an S shape and comprises a middle arm 21, a top arm 22 and a bottom arm 23 paralleling to each other. Both the upper and a lower contact 24, 25 are firmly folded in half to form a smooth and strong arc-shaped contacting end at free ends thereof. The bottom arm 23 of the deforming portion 20 further forms a bolting portion 231 symmetrically protruding along a width direction thereof.

Figure 5:
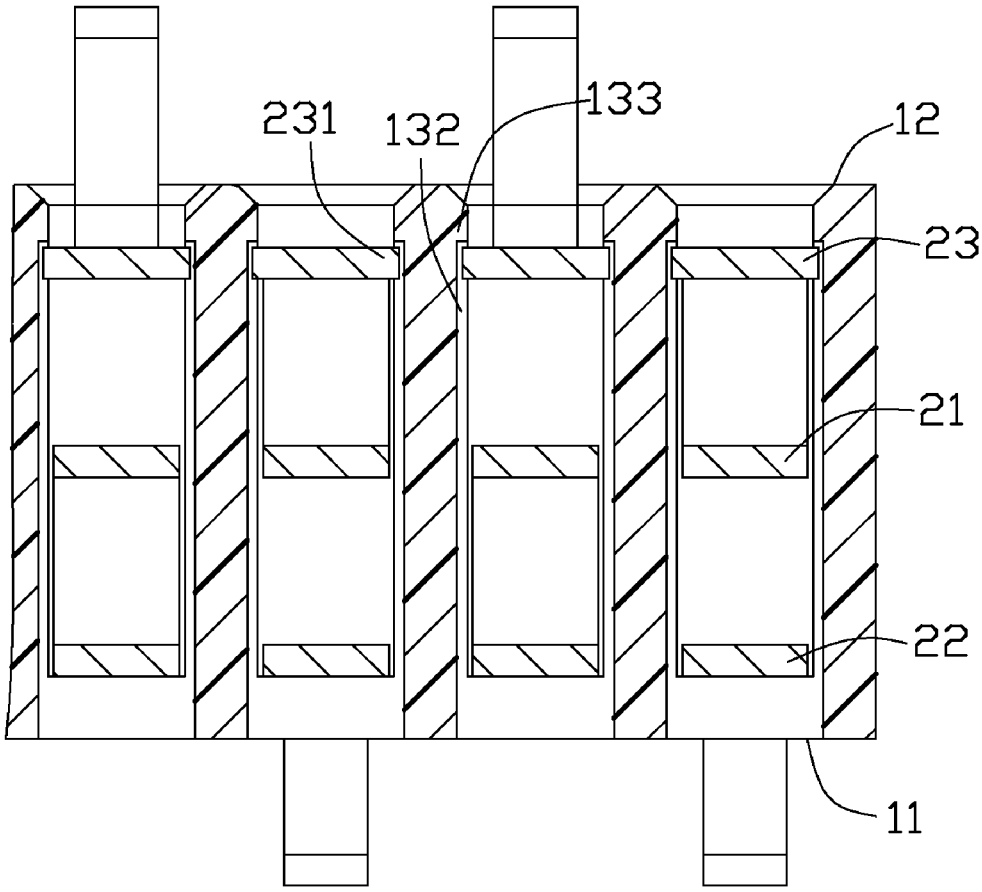
FIG. 5 is a cross section view of the compression connector taken along a broken line 5-5 in FIG. 2.

Combination with FIG. 5, the width of the terminal cavity 13 is narrower than that of the bolting portion 231 and is larger than that of any other parts of the terminal. The bolting portion 231 has a width between that of the terminal cavity 13 and the latching groove 132. The bolting portion 231 also has a length (shown in dotted line in FIG. 4) shorter than that of the latching groove 132 for proper sliding space of the bolting portion 231 and deforming space of the deforming portion 21.

Referring to FIGS. 3-5, the terminals 2 are vertically assembling into the cavities 13 from the second mating face 12. The upper contact 24 is running through and protruding out of the first mating face 11 from an opening in one row. Adjacent upper contacts are alternately located and protruding out of the first mating face 11 from an opening in another row. One of the openings in the same cavities is unused. The top arm 22 of the terminal 2 is held by the stop wall and the bottom arm 23 is locked by the latching section 133 during the bolting portion 231 is jumped into the latching groove 132. The lower contact 25 is protruding out of the second mating face 12. So, this co-used deforming portion structure of the housing 1 for restricting the deforming portion 21 is focused on holding the contact in the cavity without interference retention and the deforming portion 21 can cause compressive deformation of the whole deforming portion when either the upper contact 24 or the lower contact 25 is bearing an external pressure.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A compression connector comprising:

an insulative housing having a first mating surface and a second mating surface opposite to the first mating surface and defining a plurality of terminal cavities disposed between and running through the first and second mating faces; and a plurality of terminals assembled to the housing and each having a deforming portion received in the terminal cavity, an upper contact and a lower contact extending from opposite ends of the deforming portion, the upper contact extending beyond the first mating surface and the lower contact extending beyond the second mating surface; wherein the deforming portions are movably limited in the terminal cavities and will cause compressive deformation when either the upper contact or the lower contact is bearing an external pressure;

wherein each terminal is vertically assembled into the terminal cavity from the second mating face and the terminal further forms a bolting portion to hold the deforming portion in the cavity, the bolting portion is movably retained in the housing; wherein each terminal cavity is depressed from the second mating face and forms an opening and a stop wall on the first mating face, a latching groove with a larger width than the terminal cavity is depressed from the first mating face to form a latching section near to the second mating face, the stop wall and the latching section of the terminal cavity co-limit the terminal in an upper and lower direction; wherein a width of the terminal cavity is narrower than that of the bolting portion and is larger than that of any other parts of the terminal.

2. The compression connector as claimed in claim 1, wherein the bolting portion has a width between that of the terminal cavity and the latching groove.

3. The compression connector as claimed in claim 1, wherein each terminal is formed by bending an elongate metal sheet.

4. The compression connector as claimed in claim 1, wherein both the upper and the lower contact are firmly folded with mutual sticked inner sides to form an arc-shaped contacting ends.

5. The compression connector as claimed in claim 1, wherein the deforming portion is in an S shape and comprises a middle arm, a top arm and a bottom arm paralleling to each other, the upper and a lower contact extends from opposite ends of the S shape deforming portion.

6. A compression connector comprising:

an insulative housing defining therein a plurality of passageways side by side arranged with one another along a lengthwise direction, each of said passageways defining a bottom opening;

a plurality of contacts disposed in the corresponding passageways, respectively, each of said contacts defining a S-like configuration with opposite upper and lower contacts extending from opposite upper and lower ends of the S-like configuration upward and downward to be exposed upon opposite upper and lower faces of the housing; wherein an upper portion of the S-like configuration upwardly abuts against an underside of a top wall of the housing, and a lower portion of the S-like configuration downwardly abuts a step structure around the lower face of the housing;

wherein said S-like configuration defines two curved sides, at different levels, respectively essentially aligned with the corresponding upper and lower contacts; wherein the top wall defines, corresponding to each of said passageways, two opposite openings in a transverse direction perpendicular to said longitudinal direction, the upper contacts of said contacts are alternately disposed in the corresponding opening in a staggered manner; wherein the upper contact and the lower contact in each of said contacts are respectively located at different positions in the transverse direction; wherein a third opening is formed between the corresponding two opposite openings; wherein the upper contact and the lower contact in each of said contacts are bent in a folded manner.

7. The compression connector as claimed in claim 6, wherein each of said upper contact and said lower contact is initially bent outward and successively in said folded manner.

* * * * *